United States Patent [19]

Brown

[11] Patent Number: 4,685,514

[45] Date of Patent: Aug. 11, 1987

[54] PLANAR HEAT EXCHANGE INSERT AND METHOD

[75] Inventor: Melvin H. Brown, Freeport, Pa.

[73] Assignee: Aluminum Company of America, Pittsburgh, Pa.

[21] Appl. No.: 812,408

[22] Filed: Dec. 23, 1985

[51] Int. Cl.[4] ..... F28F 1/00

[52] U.S. Cl. ..... 165/177; 165/904; 138/38

[58] Field of Search ..... 165/904, 177, 179; 138/38

[56] References Cited

U.S. PATENT DOCUMENTS

| | | | |
|---|---|---|---|
| 1,787,904 | 1/1931 | Heyward | 165/177 |
| 2,079,144 | 5/1937 | Appa | 257/262 |
| 2,247,199 | 6/1941 | Kritzer | 29/157.3 |
| 2,254,587 | 9/1941 | Williams | 62/1 |
| 2,310,970 | 2/1943 | Limpert | 257/262 |
| 2,453,448 | 11/1948 | McTurk | 257/262.20 |
| 2,553,142 | 5/1951 | McCreary | 29/157.3 |
| 3,195,627 | 7/1965 | Goodloe | 165/181 |
| 3,468,345 | 9/1969 | Tam et al. | 138/38 |
| 3,554,893 | 1/1971 | DeVarda | 204/244 |
| 3,636,982 | 1/1972 | Drake | 138/38 |
| 3,755,099 | 8/1973 | Haupin | 204/64 R |
| 3,783,938 | 1/1974 | Charter | 165/166 |
| 3,784,371 | 1/1974 | Bangs et al. | 75/68 R |
| 3,785,941 | 1/1974 | Jacobs | 204/67 |
| 3,800,182 | 3/1974 | Wilczek | 315/3.5 |
| 3,825,063 | 7/1974 | Cowans | 165/146 |
| 3,825,064 | 7/1974 | Inoue | 165/179 |
| 3,847,212 | 11/1974 | Withers et al. | 165/179 |
| 3,859,040 | 1/1975 | Shefsiek et al. | 432/214 |
| 3,870,081 | 3/1975 | Kleppe et al. | 138/38 |
| 3,884,792 | 5/1975 | McGilvery | 204/290 F |
| 3,886,976 | 6/1975 | Kardar et al. | 165/904 X |
| 3,895,675 | 7/1975 | Rein et al. | 165/164 |
| 3,996,117 | 12/1976 | Graham et al. | 204/67 |
| 4,049,511 | 9/1977 | Alder et al. | 204/67 |
| 4,090,559 | 5/1978 | Megerlin | 165/179 |
| 4,098,651 | 7/1978 | Alder | 204/1 T |
| 4,106,558 | 8/1978 | Neveus | 138/38 |
| 4,110,178 | 8/1978 | LaCamera et al. | 204/64 R |
| 4,113,009 | 9/1978 | Meyer et al. | 165/154 |
| 4,116,270 | 9/1978 | Marushkin et al. | 165/162 |
| 4,119,519 | 10/1978 | Clapper | 204/268 |
| 4,121,983 | 10/1978 | Kinosz et al. | 204/67 |
| 4,147,210 | 4/1979 | Pronko et al. | 165/165 |
| 4,170,533 | 10/1979 | Alder et al. | 204/243 R |
| 4,197,169 | 4/1980 | Zahn et al. | 204/1 R |
| 4,197,178 | 4/1980 | Pellegri et al. | 204/255 |
| 4,243,502 | 1/1981 | Kugler | 204/243 R |
| 4,257,855 | 3/1981 | Zaromb | 204/67 |
| 4,265,275 | 5/1981 | Heller et al. | 138/38 |
| 4,279,731 | 7/1981 | Pellegri | 204/254 |
| 4,288,309 | 9/1981 | Cohen | 204/225 |
| 4,296,779 | 10/1981 | Smick | 138/38 |
| 4,306,619 | 12/1981 | Trojani | 165/179 |
| 4,341,262 | 7/1982 | Alspaugh | 165/1 |
| 4,351,392 | 9/1982 | Stockman | 165/904 X |
| 4,352,378 | 10/1982 | Bergmann et al. | 138/38 |
| 4,559,998 | 12/1985 | Counterman | 165/904 X |

FOREIGN PATENT DOCUMENTS

| | | | |
|---|---|---|---|
| 149882 | 8/1920 | United Kingdom | 165/177 |
| 706197 | 3/1954 | United Kingdom | 138/38 |
| 1462332 | 1/1977 | United Kingdom | 165/177 |

OTHER PUBLICATIONS

Machine Design, Feb. 25, 1982, p. 44.

*Primary Examiner*—Albert W. Davis, Jr.
*Assistant Examiner*—Peggy Neils
*Attorney, Agent, or Firm*—Douglas G. Glantz

[57] ABSTRACT

The present invention provides heat transfer apparatus and method for enhancing the heat transfer of fluid passing along a tubular heat exchange surface including positioning a heat exchange insert of planar or, sheet-like shape to form an unobstructed area of about 20%-80% of the tubular cross section. The heat exchange insert is constructed of a material having an absorptance and emittance to provide high radiative heat transfer over a substantially unobstructed line of sight between the insert surface and the tubular surface. Heat exchange inserts are further positioned in the tube or pipe to increase the mass of fluid contacting the insert by alternating the position of insert in the tube.

9 Claims, 4 Drawing Figures

PLANAR HEAT EXCHANGE INSERT AND METHOD

BACKGROUND OF THE INVENTION

This invention relates to an apparatus and method for enhancing heat transfer in a heat exchanger.

Heat transfer between a fluid flowing along a heat exchanger surface is confined primarily to a layer of the fluid in contact with the surface of the heat exchanger. Fin structures extending from the heat exchanger surface and contacting the fluid have been used by others to set up a flow disturbance which prevents this stratifying or laminar flow of the fluid flowing against the heat exchanger surface. The fins typically are formed to contact the heat exchanger surface and provide higher conductive heat transfer from the fluid to the surface.

In the case of fluid flowing in heat exchanger tubes, it is well known to use inserts to provide a turbulent flow of the fluid against the inside surface of the tube. Such tube inserts for producing turbulence are often called turbulators. The turbulator in the tube improves heat transfer, primarily by slowing down the velocity of the fluid flowing through the central portion of the tube or pipe cross section, and further improves the temperature distribution of the fluid in the cross section of the tube or pipe by conduction and mixing.

In heat transfer applications at high temperatures, radiative heat transfer takes on a dominant influence over convection and conductive heat transfer. Previous attempts have been made to take advantage of the higher radiation heat transfer by providing reradiant inserts, e.g., such as in flue gas recuperators. One such reradiant insert is disclosed in Kardas et al, U.S. Pat. No. 3,886,976. The Kardas insert uses a floating extended surface, i.e., an additional area accepting heat by convection and radiation from the hot gas, not integrally connected with the original heat receiving surface. Heat then is retransmitted to the original surface by the continuous spectrum of Stefan-Boltzmann radiation. Radial mixing and large effective radiating area can be obtained by using multileaf reradiators of the type shown in the Kardas patent in FIG. 5.

The aforementioned turbulators are designed for lower temperature operation and, for that reason, do not produce the most efficient heat exchanger insert at higher temperatures.

It is an object of the present invention to provide heat exchanger apparatus and method for enhancing heat exchange between a fluid and a heat exchanger surface, e.g., such as a heat exchanger tube.

It is another object of the present invention to provide heat exchanger apparatus and method of enhanced efficiency at higher temperature differences between the fluid and heat exchanger surface.

It is yet another object of the present invention to provide heat exchanger apparatus and method of enhanced efficiency at higher flow rates and pressure drops through a tubular heat exchanger.

SUMMARY OF THE INVENTION

In accordance with the present invention, heat exchanger apparatus and method are provided for enhancing the heat transfer between a fluid and a tubular heat exchanger surface. Heat exchange apparatus includes a tubular heat transfer surface, means for passing a heat transfer fluid along the surface, and a planar heat exchange insert positioned to impinge the fluid and having a longitudinal axis and a lateral axis shorter than the longitudinal axis, the axes being at right angles. The edges of the insert parallel to the lateral axis abut the heat exchanger surface and the edges parallel to the longitudinal axis are positioned to maintain an unobstructed space between the edges and the heat exchanger surface of about 20%–80% of the tubular cross section. The apparatus includes a plurality of said inserts arranged in series so that the longitudinal axis of each insert is rotated to about 45° to 90° from the adjacent insert. The inserts are composed of a material having a high absorptance and emittance.

The method of the present invention includes establishing the heat transfer insert of the present invention of planar or sheet construction positioned in a tube or channel to impinge the flow of a heat exchanger fluid both on the surface of the inserts and the surface of the tube or channel and to enhance the heat exchange between said fluid and a heat exchanger surface.

DETAILED DESCRIPTION OF THE INVENTION

Figure 1:
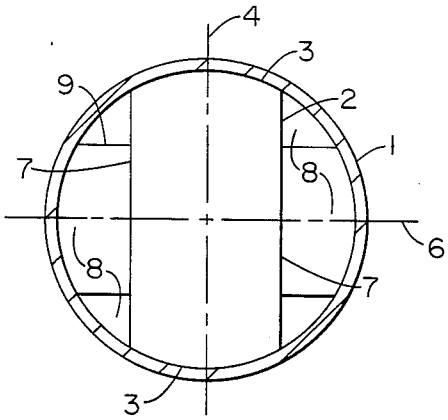
FIG. 1 depicts a cross sectional view of a heat exchanger tube including an insert according to the present invention.

Heat transfer involves three fundamental mechanisms: conduction, convection, and radiation. Conduction involves heat transfer from one location of a unit mass to another location of the same unit mass or from a first unit mass to a second unit mass in physical contact with the first without significant movement of the particles of the unit's mass. Convection involves heat transfer from one location to another location within a fluid, either gas or liquid, by mixing within the fluid. Natural convection involves motion of the fluid from density differences attributable to temperature differences. Forced convection involves motion in the fluid set up by mechanical work applied to the fluid. At low forced velocities in the fluid, density and temperature differences are more important than at higher forced velocities. Radiation involves the heat transfer from one unit mass to another unit mass not contacting the first. Radiation takes place through a wave motion through space.

Heat transfer by conduction can be described by a fundamental differential equation known as Fourier's Law:

$$\frac{dQ}{d\theta} = -kA\frac{dt}{dx} \tag{1}$$

wherein $dQ/d\theta$ (quantity per unit time) is heat flow rate; A is area at right angles to the direction of heat flow; and $-dt/dx$ is temperature change rate with respect to distance in the direction of heat flow, i.e, temperature gradient. The thermal conductivity is defined by k, which is dependent on the material through which the heat flows and further is dependent on temperature. Convective heat transfer involves a coefficient of heat transfer which is dependent on characteristics of fluid flow. Turbulent flow of a fluid past a solid sets up a relatively quiet zone of fluid, commonly called a film in the immediate vicinity of the surface. Approaching the wall from the flowing fluid, the flow becomes less turbulent and can be described as laminar flow near the surface. The aforementioned film is that portion of the fluid in the laminar motion zone or layer. Heat is transferred through the film by molecular conduction. In this latter aspect, light gases have the most resistance to heat transfer through the film and liquid metals have the least resistance through the laminar film region. The equation for describing heat transfer from the flowing fluid to the surface is set forth as follows in equation (2).

$$Q = hA\Delta T \tag{2}$$

wherein

Q = Quanity of heat transferred per unit time Btu/hr.

h = Coefficient of heat transfer = quantity of heat Btu/(hr ft$^2$°F.) transferred per unit area and unit time per unit of temperature difference across the film.

T = Temperature difference between the gas and surface-°F.

Thermal radiation heat transfer involves an electromagnetic transport of energy from an emitting source excited by temperature. The energy is absorbed in another matter at distances from the emitting source in amounts dependent on the mean free path of the electromagnetic energy being transported. Radiation is different from conduction and convection mathematically based not only on this mean free path but also on a much more significant influence by temperature differences. In general, thermal radiation heat transfer can be described by the following equation:

$$Q = 0.172\,A\left[\left(\frac{T_1}{100}\right)^4 - \left(\frac{T_2}{100}\right)^4\right](F_A)(F_E) \tag{3}$$

wherein

Q = Net rate of heat radiation Btu/hr.

A = Area of one of the two surfaces-ft$^2$.

$T_1$ = Temperature of hottest surface-°R.

$T_2$ = Temperature of coolest surface-°R.

$F_A$ = Factor related to angle throughout which one surface sees the other.

$F_E$ = Emissivity factor.

A significant problem with heat transfer from gases to a surface is a high convective heat transfer resistance attributable to gas films. The present invention overcomes this problem and provides a much higher radiative heat transfer rate by gases flowing to impinge a heat exchange insert as contrasted to gases otherwise flowing inside pipes.

When high temperatures are involved, much more heat can be transferred by radiation than by convection. In accordance with the present invention, heat transfer rates for gases flowing inside pipes or channels are increased significantly by combining radiative heat transfer with convective and conductive effects. Planar heat exchange inserts are positioned to impinge the flow of gas in the pipe. Further, these planar heat exchange inserts are established to have emissivities or absorptivities above about 0.5 or 50%, and preferably close to about unity or 100% to obtain maximum heat transfer by radiation. Materials of construction include temperature resistant metal oxides or ceramics. The heat exchange inserts are positioned to provide a high surface area normal to the flow of fluid, but spaced apart sufficiently to provide high radiative heat transfer penetrating to the heat transfer surface from the inserts over a substantially unobstructed mean free path.

The present invention provides a heat transfer insert of a planar or sheet-like shape positioned in a pipe, tube, or channel to enhance the heat transfer characteristics of a fluid flowing in a pipe or the like to transfer heat energy from the fluid to the inside surface of the pipe.

A heat transfer insert of planar or sheet-like shape is provided by a planar member formed to have a longitudinal axis and a lateral axis shorter than the longitudinal axis. The edges of the insert parallel to the lateral axis are positioned to abut the tubular heat transfer surface. The edges of the insert parallel to the longitudinal axis are positioned to maintain a space or unobstructed void of about 20% to 80% of the tubular cross-sectional area.

Below about 20%, excessive pressure drop occurs. Above about 80%, impingement is inadequate.

Figure 2:
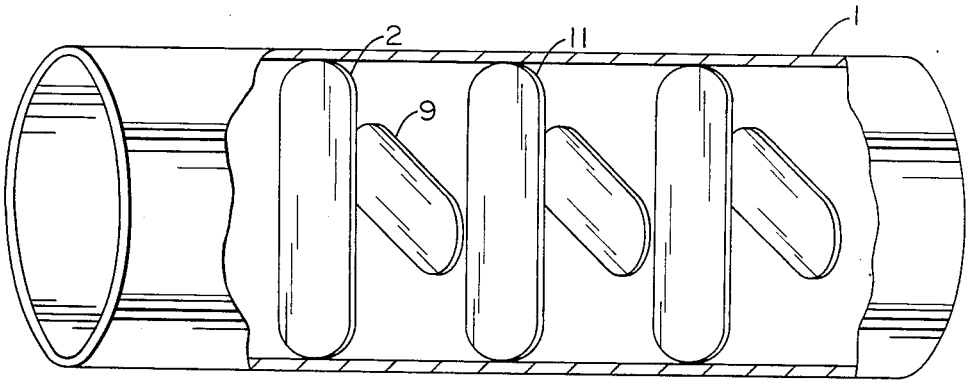
FIG. 2 depicts a longitudinal cutaway view of a heat exchanger tube containing a heat exchanger insert according to the present invention.

Referring now to FIG. 1, an elevational view of a cross section of pipe 1 is depicted. Heat exchange insert 2 is provided in pipe 1 with the ends 3 of heat exchange insert 2 contacting the inside surface of pipe 1. Heat exchange insert 2 has longitudinal axis 4 and lateral axis 6 shorter than longitudinal axis 4. The ends 3 of insert 2 are parallel to lateral axis 6. The insert is shaped so that the ends 7 parallel to longitudinal axis 4 are positioned in pipe 1 to form an unobstructed void, depicted as 8, of about 20% to 80% of the pipes tubular crosssectional area. Another heat exchange insert 9 is positioned behind adjacent insert 2. Inserts 2 and 9 are positioned in alternating perspective to fluid (not shown) flowing through pipe 1. The inserts as shown in FIG. 1 are positioned alternating at 90° offset. A third insert 11 of identical construction in conformance with a 90° offset would be positioned substantially behind heat exchange insert 9 rotated 90° as depicted in FIG. 2. The angle of offset can vary from 90°, e.g., such as by an alternating angle of 45°. Alternating offsets of smaller angle dimensions position the heat exchange insert so that fluid flowing through pipe 1 impacts the insert at a normal or perpendicular angle with less obstruction.

FIG. 2 shows an elevational view of pipe 1 from the side, and heat exchange inserts 2, 9, and 11 are shown in a cutaway view of pipe 1. Successive inserts are depicted having alternating offset angles at 90°.

Figure 3:
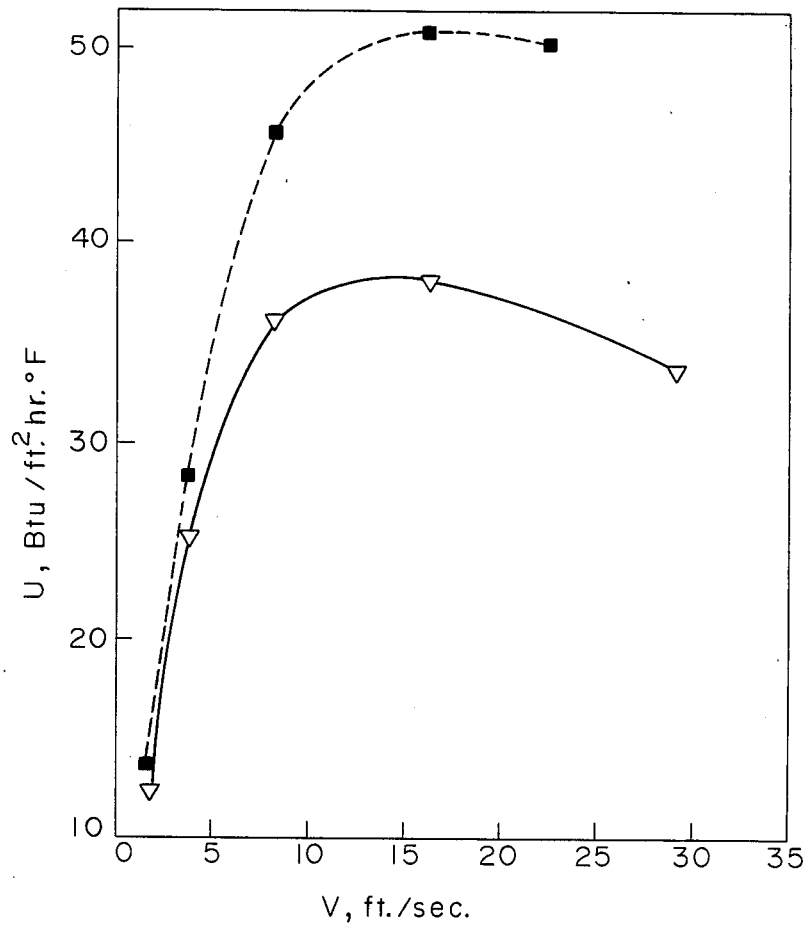
FIG. 3 shows a graphical correlation of heat transfer comparisons between the heat exchanger insert of the present invention and prior art inserts.

The heat exchange inserts having a substantially planar shape and positioned in accordance with the present invention have been found to provide enhanced heat transfer coefficients. Referring to FIG. 3, a graphical depiction of enhanced heat transfer is shown for the heat exchange insert according to the present invention.

The heat transfer curve formed by square data points as shown in FIG. 3 was provided by 1.5 inch inserts placed 24 per foot of pipe to establish 1.5 ft$^2$/ft for total area of planar inserts. The heat transfer curve formed by the triangle data points was provided by a 3 inch diameter wire brush of 0.014 inch diameter wire placed 3,300 per foot of pipe to establish 3.0 ft$^2$/ft for total area of wire inserts. The insert of the present invention provides an enhanced heat transfer in Btu/ft$^2$-hour-°F. at all velocities of fluid flowing through a pipe. The insert of the present invention provides particularly enhanced heat transfer at fluid velocities above about 5 feet per second.

Figure 4:
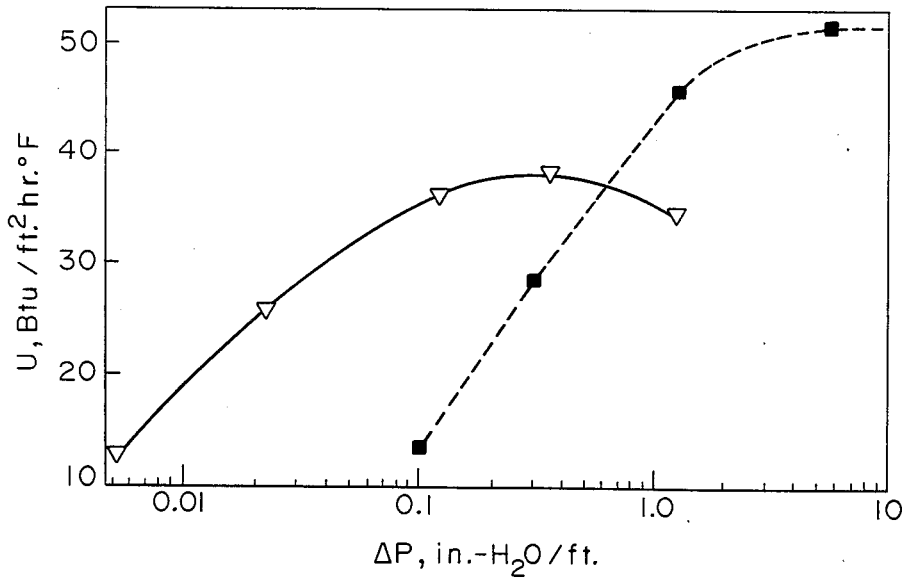
FIG. 4 shows heat transfer coefficients produced by the heat exchanger insert of the present invention compared to prior art inserts.

A similar graphical depiction of the enhanced heat transfer attributable to the heat exchange insert of the present invention is shown in FIG. 4 for heat transfer versus pressure drop through, the pipe. The heat exchange insert of the present invention operates most efficiently at high pressure drop through the pipe, i.e., such as at $\Delta P/ft$ (inches $H_2O/ft$) higher than about 0.7, preferably higher than about 1.0.

While the invention has been described in terms of preferred embodiments, the claims appended hereto are intended to encompass all embodiments which fall within the spirit of the invention.

What is claimed is:

1. A method of increasing the heat transfer between a gas flowing in a tube and the surface of the tube comprising:

establishing a plurality of planar heat exchange inserts positioned to impinge the flow of said gas along the tube surface, said inserts composed of a material having an absorptance and an emittance of at least about 50%, and each insert having a longitudinal axis and a lateral axis shorter than the longitudinal axis, said axes being at right angles to form a plane positioned to provide a substantially flat planar heat exchange surface normal to said gas flow;

providing a substantially unobstructed line of sight between each said insert and said tube surface;

positioning each said insert so that the edges parallel to the lateral axis abut the tube surface or tube wall, while providing a clearance between the tube surface or tube wall and the edges parallel to the longitudinal axis to maintain an unobstructed space of between about 20% to 80% of the cross sectional area of the tube; and arranging the inserts in series so that the longitudinal axis of each insert is rotated 45° to 90° from the adjacent insert.

2. A method as set forth in claim 1, said planar heat exchange insert having a surface comprising a temperature resistant, low thermally conductive metal oxide or ceramic.

3. A method as set forth in claim 2 wherein said heat exchange inserts are composed of a material having an absorptance and emittance which approach about 100%.

4. A method as set forth in claim 3 wherein the gas flow in the tube exceeds five feet per second.

5. A methd as set forth in claim 3 wherein the pressure drop in the tube exceeds 0.7 inches $H_2O/ft$.

6. A method as set forth in claim 5 wherein said pressure drop exceeds 1.0 inches $H_2O/ft$.

7. Heat transfer means as set forth in claim 6 wherein said heat transfer surface comprises the inner surface of a pipe or tube.

8. Heat transfer means as set forth in claim 7 wherein said end points parallel to the insert's lateral axis contact the pipe.

9. Heat transfer means as set forth in claim 8 wherein said inserts are composed of ceramic materials having melting points higher than 1500° C.

* * * * *